US008453858B2

(12) United States Patent
Wohlgenannt

(10) Patent No.: US 8,453,858 B2
(45) Date of Patent: Jun. 4, 2013

(54) COVER FOR CLOSING CONTAINERS

(75) Inventor: Herbert Wohlgenannt, Thayngen (CH)

(73) Assignee: Capartis AG, Schaffhausen (CH)

( * ) Notice: Subject to any disclaimer, the term of this patent is extended or adjusted under 35 U.S.C. 154(b) by 11 days.

(21) Appl. No.: 12/919,909

(22) PCT Filed: Feb. 28, 2008

(86) PCT No.: PCT/EP2008/052460

§ 371 (c)(1),
(2), (4) Date: Aug. 27, 2010

(87) PCT Pub. No.: WO2009/106137

PCT Pub. Date: Sep. 3, 2009

(65) Prior Publication Data

US 2011/0017697 A1 Jan. 27, 2011

(51) Int. Cl.

| | |
|---|---|
| ***B65D 41/32*** | (2006.01) |
| ***B65D 17/34*** | (2006.01) |
| *B67B 7/16* | (2006.01) |
| *B67B 7/62* | (2006.01) |

(52) U.S. Cl.
USPC ..... 215/253; 220/270; 81/3.15

(58) Field of Classification Search
USPC ..... 81/3.29, 3.37, 3.36, 3.57, 3.55, 3.44, 81/3.41, 3.4, 3.15, 3.07; 222/153.1
IPC ..... B65D 41/32,17/34; B67B 7/16, 7/62, B67B 7/44
See application file for complete search history.

(56) References Cited

U.S. PATENT DOCUMENTS

| | | | | |
|---|---|---|---|---|
| 2,046,173 | A * | 6/1936 | Lenhoff | 215/304 |
| 3,656,648 | A * | 4/1972 | Powaloski et al. | 215/253 |
| 3,774,797 | A * | 11/1973 | Vliet | 215/253 |

(Continued)

FOREIGN PATENT DOCUMENTS

| | | |
|---|---|---|
| EP | 0 322 366 | 6/1989 |
| FR | 1 397 071 | 4/1965 |
| FR | 2 432 450 | 2/1980 |

(Continued)

OTHER PUBLICATIONS

International Search Report, issued Nov. 21, 2008, for PCT International Application No. PCT/EP2008/052460.

*Primary Examiner* — Jacob K Ackun
*Assistant Examiner* — Robert J Hicks
(74) *Attorney, Agent, or Firm* — Pearl Cohen Zedek Latzer, LLP

(57) ABSTRACT

A closure cap for containers has a cap mantle, a circular head portion with a central axis and a pivoting member (4). The cap mantle extends in the same general direction as the central axis, and in which, the cap mantle has a ripping-open-section extending circumferentially with respect thereto. The pivoting member (4) is attached to the ripping-open-section and extends in the same general direction as the central axis. Towards the head portion, the ripping-open-section comprises a thin region, which extends circumferentially with respect to the central axis and which forms a rotational axis. The pivoting member comprises a stop member, which extends in the same general direction as the central axis at least up to the rotational axis. The form of the stop member and its relative, spaced position with respect to the head portion are such that pivoting of the pivoting member around the rotational axis causes the stop member to lie against the head portion.

19 Claims, 6 Drawing Sheets

U.S. PATENT DOCUMENTS

Figure 1:
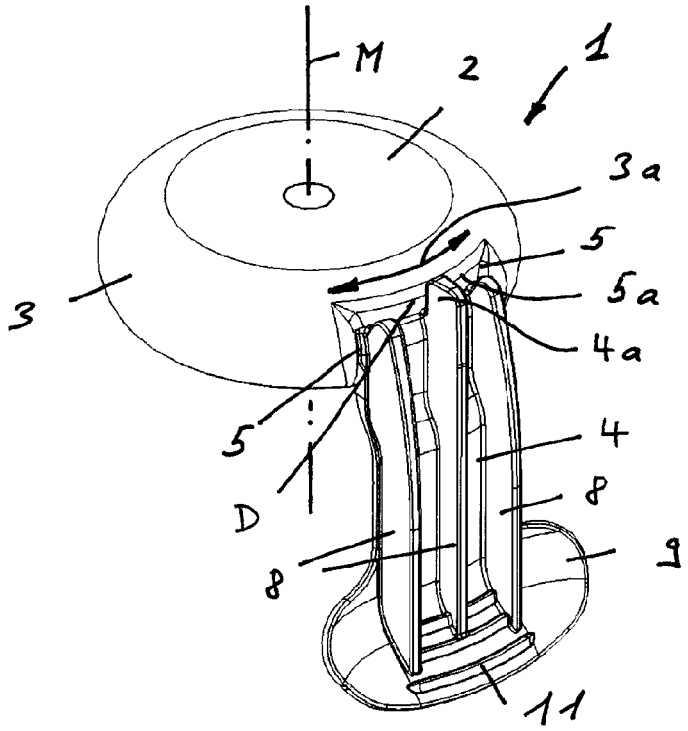

| | | | | |
|---|---|---|---|---|
| 3,976,215 | A * | 8/1976 | Smalley | 215/253 |
| 4,399,924 | A * | 8/1983 | Nilsson | 220/255.1 |
| 4,768,667 | A * | 9/1988 | Magnusson | 215/255 |
| 6,260,723 | B1 * | 7/2001 | Bergholtz | 215/344 |
| 2003/0201266 | A1 * | 10/2003 | Steffan | 220/258.2 |
| 2005/0072787 | A1 * | 4/2005 | Morris et al. | 220/712 |
| 2006/0043053 | A1 * | 3/2006 | Herald et al. | 215/253 |

FOREIGN PATENT DOCUMENTS

| | | | |
|---|---|---|---|
| JP | 06072451 | A * | 3/1994 |
| WO | WO 01/68467 | | 9/2001 |
| WO | WO 2005/115865 | | 12/2005 |

* cited by examiner

COVER FOR CLOSING CONTAINERS

CROSS-REFERENCE TO RELATED APPLICATIONS

This application is a National Phase Application of PCT International Application No. PCT/EP2008/052460, International Filing Date Feb. 28, 2008, which is hereby incorporated by reference in its entirety.

FIELD OF THE INVENTION

The present invention relates to closure caps, for example for closing containers.

BACKGROUND

The document WO 2005/115865 A1 discloses a closure cap for containers and bottles. This closure cap—in the form of a tamper-evident, screw-type closure—consists of a screw cap with an internally-threaded cylindrical mantle and an annular tamper-evident band, which is connected by intentionally-frangible bridges to the free edge of the mantle. When first opening the tamper-evident, screw-type closure, the screw cap is rotated and thus raised, whereas the bead on the inner surface of the tamper-evident band is positioned against and held back by the tamper-evident-band-ring on the neck of the container, such that the intentionally-frangible bridges tear at some point during opening. From the torn, intentionally-frangible bridges, it is thus possible to recognise that the bottle (respectively the tamper-evident screw closure) has been opened once already.

The above-mentioned closure cap has the disadvantage that it is not really suitable for certain containers and/or certain beverages. Beyond this, it is difficult to recognise whether the closure cap has been opened once already.

SUMMARY OF THE INVENTION

The objective of the present invention is thus to provide a more expedient closure cap, the opening of which is also better recognisable.

This problem is solved by a closure cap having the features of the claims, which recite advantageous embodiments.

In particular the problem is solved by a closure cap for closing containers, comprising a cap mantle, a circular head portion with a central axis and a pivoting member, in which, starting from the head portion, the cap mantle extends in the same general direction as the central axis, and in which the cap mantle has a ripping-open-section extending circumferentially with respect to the central axis, and in which the pivoting member is attached to the ripping-open-section and extends in the same general direction as the central axis, and in which, towards the head portion, the ripping-open-section comprises a thin region, which extends circumferentially with respect to the central axis and which forms a rotational axis and in which the pivoting member comprises a stop member, which extends in the same general direction as the central axis at least up to the rotational axis, and in which the form of the stop member and its relative, spaced position with respect to the head portion are such that a pivotation of the pivoting member around the rotational axis causes the stop member to lie against the head portion.

The closure cap according to the present invention has a ripping-open-section and a pivoting member, wherein the pivoting member is attached to the ripping-open-section. During opening, the pivoting member is pivotable relative to the rest of the closure cap such that the ripping-open-section is damaged at least in certain places and preferably is completely parted, whereby the closure cap can be at least partially opened. During opening, the pivoting member also serves as a sort of integrated bottle opener in that, beyond a certain degree of pivotation, the pivoting member contacts the head portion of the closure cap, whereby the pivoting member engages with the head portion like a lever, which facilitates the complete lifting off of the closure cap. In one particularly advantageous embodiment, after the pivoting member contacts the head portion of the closure cap, the closure cap is slightly lifted with respect to the outlet orifice of the bottle—preferably on the side on which the pivoting member is—such that a fluid-conducting channel is effectuated between the interior and the exterior of the bottle along which fluid can escape. This embodiment has the advantage that the degassing of a pressurised bottle can be carried out in a conscious and controlled manner, in particular before the closure cap is completely removed. The closure cap according to the present invention is preferably opened such that in a first partial movement, the pivoting member is moved until degassing occurs. After successful degassing, the pivoting member is then moved further in a second partial movement and the closure cap is completely removed from the bottle. It is thus ensured that the closure cap does not release from the bottle in an uncontrolled or even gunshot-like manner.

In one advantageous embodiment, the ripping-open-section is delimited by a defined, predetermined weak region, such that this tears during pivotation of the pivoting member. This embodiment has the advantage that the closure cap, in serving as a tamper-evident closure, is damaged at a defined, preferably easily-visible location. Also, the effort required to pivot the pivoting member can thereby be reduced.

In one advantageous embodiment the pivoting member has three stiffening ribs on its outer side. Preferably, the middle one of the three ribs, which extend in the same general direction as the central axis, is made longer than the two other ribs towards the rotation axis D, whereby the middle rib serves not only as a stiffener for the pivoting member, but also functions as an opening rib, in that, during opening of the pivoting member, as from a particular pivotal position, this lengthened, middle rib lies against the head portion of the closure cap and thereby levers the closure cap open.

In one advantageous embodiment, the pivoting member remains in a pivoted position after opening or, stated differently, the pivoting member does not resume the original starting position in which the pivoting member was before opening of the closure cap. This embodiment has the advantage that the opening of the closure cap is immediately and unambiguously apparent, even at a distance, from the position of the pivoting member with respect to the rest of the closure cap. When unopened, the pivoting member preferably runs along the same general line of direction as the central axis. When opened, the pivoting member runs at an angle or perpendicular to the central axis. For a closure cap on a container, it is thus immediately apparent whether the pivoting member is running in the same general direction as the central axis (i.e. generally in line with the container) or whether the pivoting member is running at an angle to the central axis (i.e. generally out of line with the container). Also, it is possible to visually recognise whether the closure cap has been opened once already from the state of the weak regions, which are preferably torn following opening.

In one advantageous embodiment, the closure cap according to the invention is formed such that it can be put back onto the container outlet orifice—in particular though snapping back on—after opening and complete removal, such that the container can be reclosed, for example to protect the outlet orifice from contamination. Even on reclosing of the container, it is easily and unambiguously apparent that the closure cap has been opened once already based on the parted weak regions and preferably also based on the pivoting member sticking out at an angle.

The closure cap according to the invention also has the advantage that no loose tamper-evident band remains on the neck of the bottle, or that during opening no separate, loose tamper-evident or rip-off band is created that needs to be thrown away separately. For this reason, the closure cap requires less material for its manufacture and/or is more aesthetically pleasing since no separated tamper-evident part remains on the bottle neck for visualisation of opening. A particular advantage of the closure cap according to the invention may be seen in the fact that the projecting pivoting member can serve as a tamper-evident feature, wherein this tamper-evident feature is quasi-integrated into the closure and also serves as an opening aid.

The use of the closure cap according to the present invention is particularly advantageous in combination with a bottle neck whose outlet orifice has the geometry of a standard beer bottle. Such a standard beer bottle has an outlet orifice which usually ends in a beadlike thickening. Such a standard beer bottle has no screw thread at the outlet orifice. Thus, the closure cap according to the present invention enables the creation of an easy-to-use tamper-evident closure which may be used for such standard beer bottles. Since these closure caps preferably do not require an inner screw thread, the closure cap can be made very short in the general line of direction of the central axis. Also, no screw thread is required on the bottle neck, such that this may also be made relatively short. The closure cap according to the present invention thus allows a significant saving of material in the manufacture of the bottle and of the closure cap since both can be made very short in the general line of direction of the central axis.

The closure cap according to the present invention has the advantage that it can be applied to glass and PET bottles, that it is pressure-tight and preferably can also have a gas barrier and an oxygen absorber. The closure cap according to the present invention is preferably made out of a plastic.

The document WO 2005/115865 A1 discloses a rotatable closure cap for the pressure-tight closure of bottles, in which the closure cap has an oxygen absorber. This closure cap has the disadvantage that it is not really suitable for certain beverage products. For closing beer bottles, this closure cap is peculiar, strange and out of place. The closure cap according to the present invention has the advantage that, in particular, it is suited to the closure of beer bottles. The closure cap according to the present invention has the advantage for the consumer that the classic character of beer packaging/closure can be retained, since no screw thread is required at the bottle neck. The closure cap according to the present invention allows the closure of conventional beer bottles, wherein the closure cap is formed as a tamper-evident closure from which opening is recognisable. In a preferred embodiment, the beer bottle can also be reclosed after opening with the closure cap according to the present invention. Thanks to the pivoting member, the closure cap can also be opened without great effort and, if desired, even with a single finger.

In a particularly preferred embodiment, the closure cap is made such that it may be produced by injection moulding using simple open-shut tooling, which enables very cost-effective manufacture.

In the following, the invention is described in detail with the help of several examples of embodiments.

SHORT DESCRIPTION OF THE DRAWINGS

Figure 2:
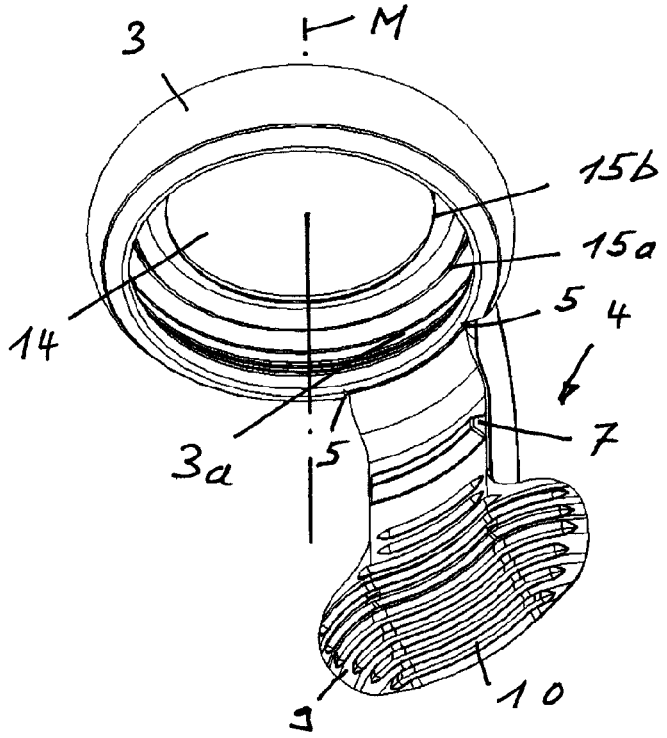
Figure 3:
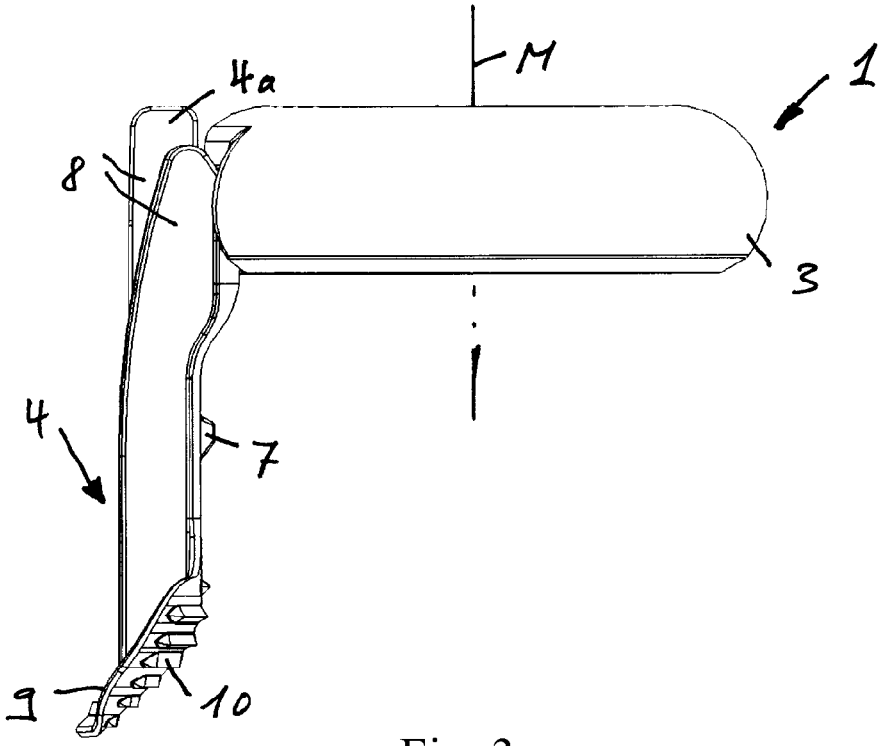
Figure 4:
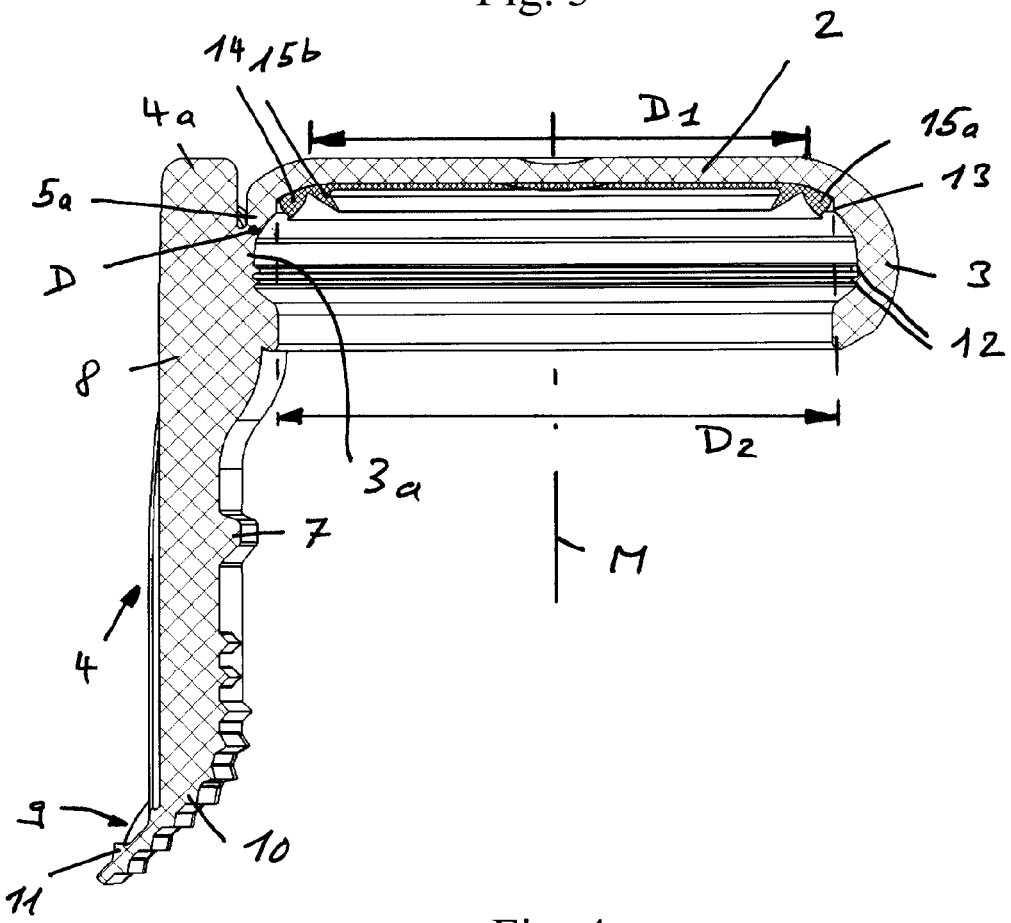
Figure 5:
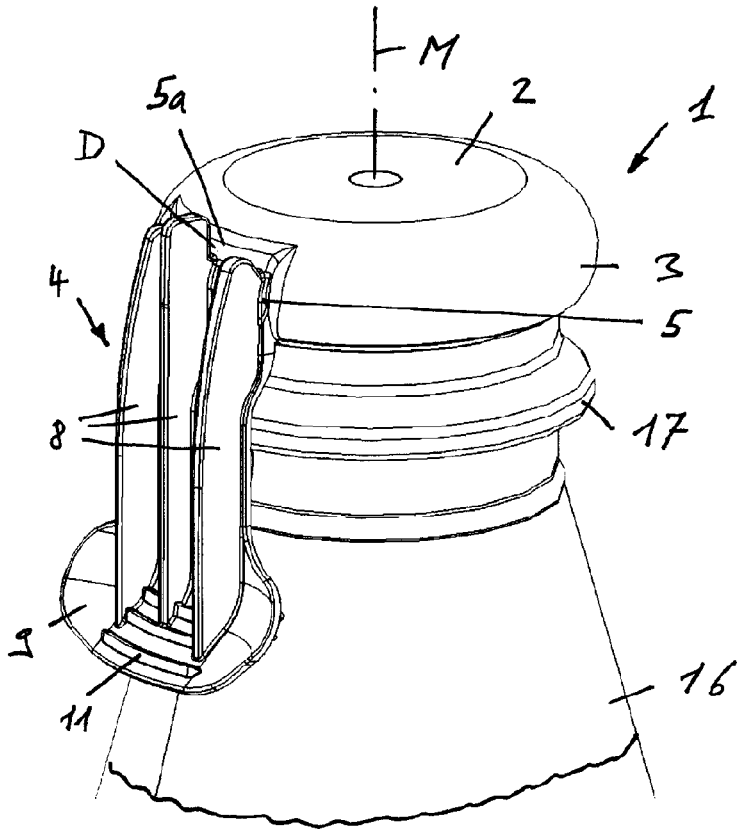
Figure 6:
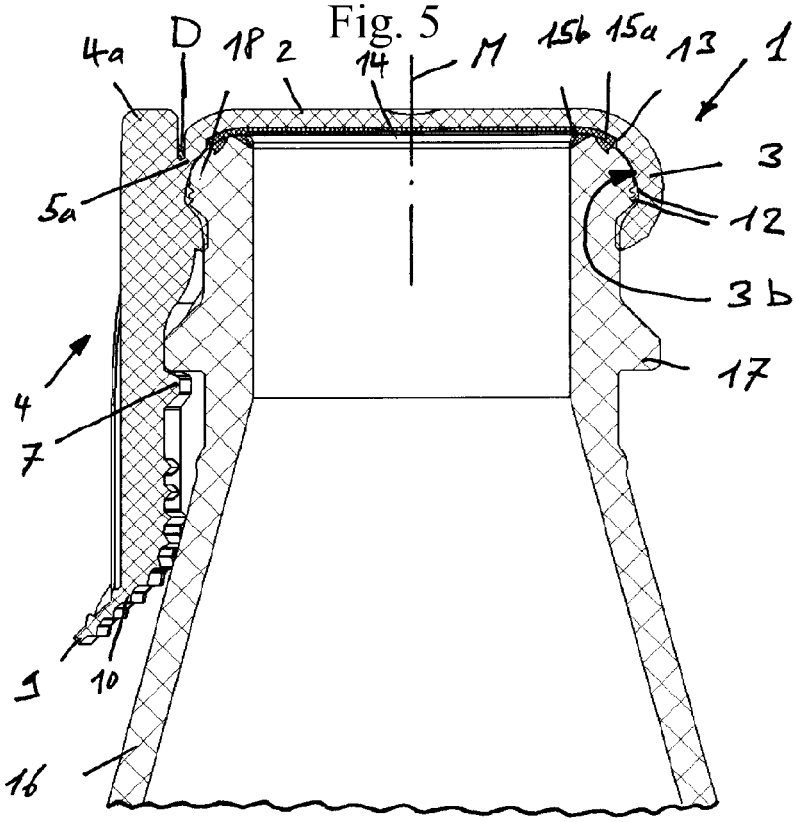
Figure 7:
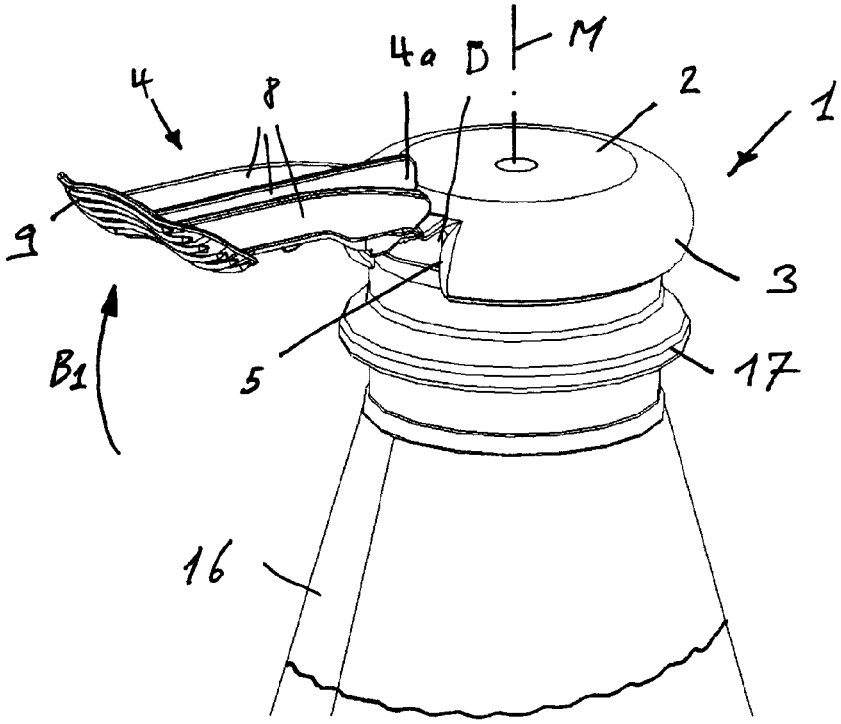
Figure 8:
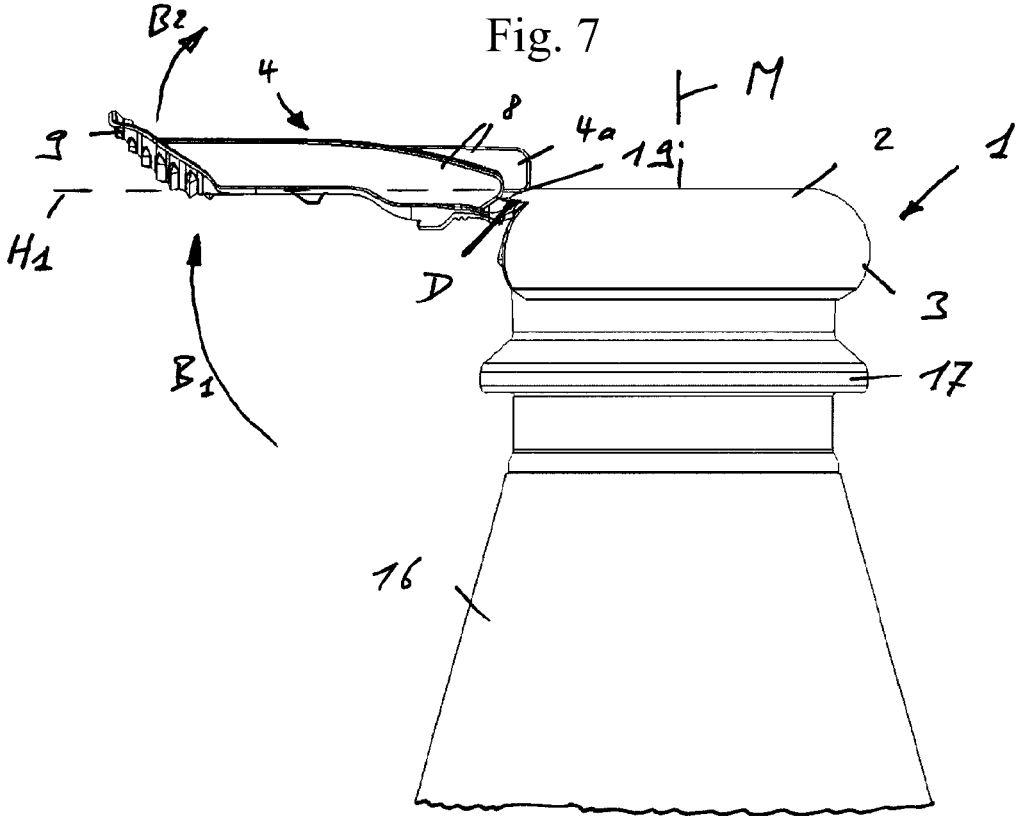
Figure 9:
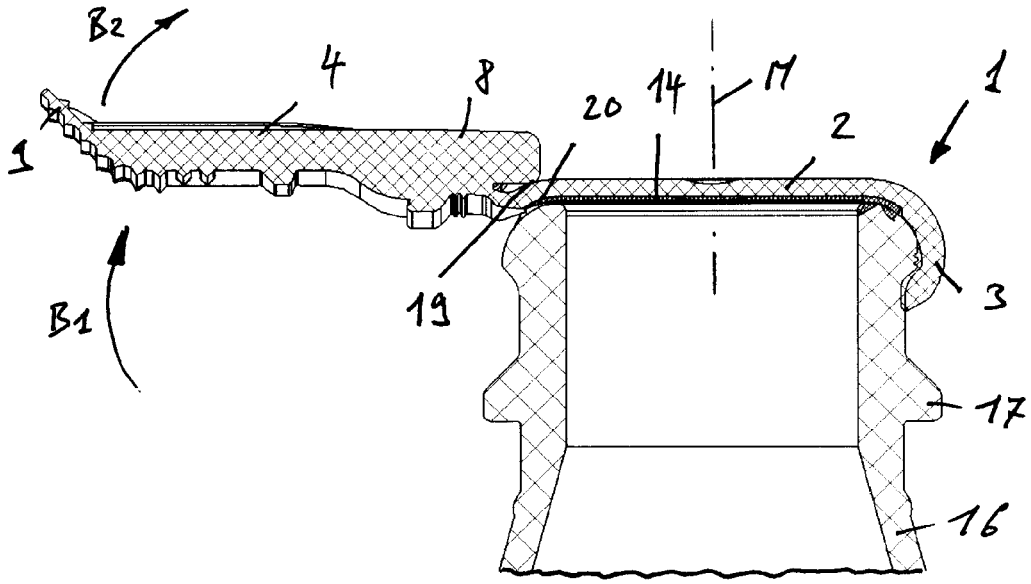
Figure 10:
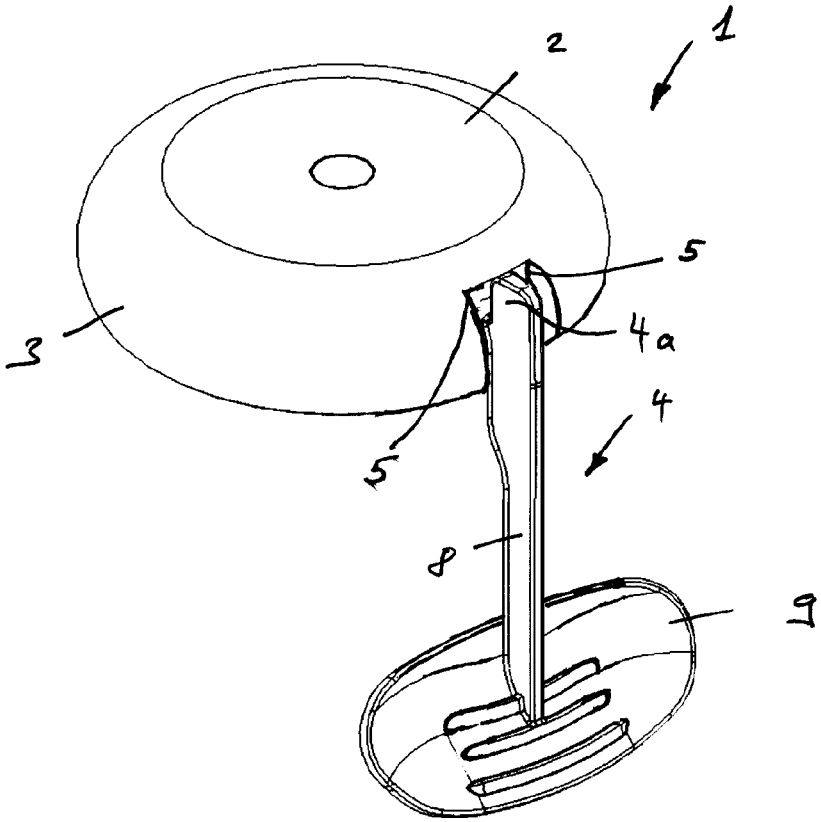
Figure 11:
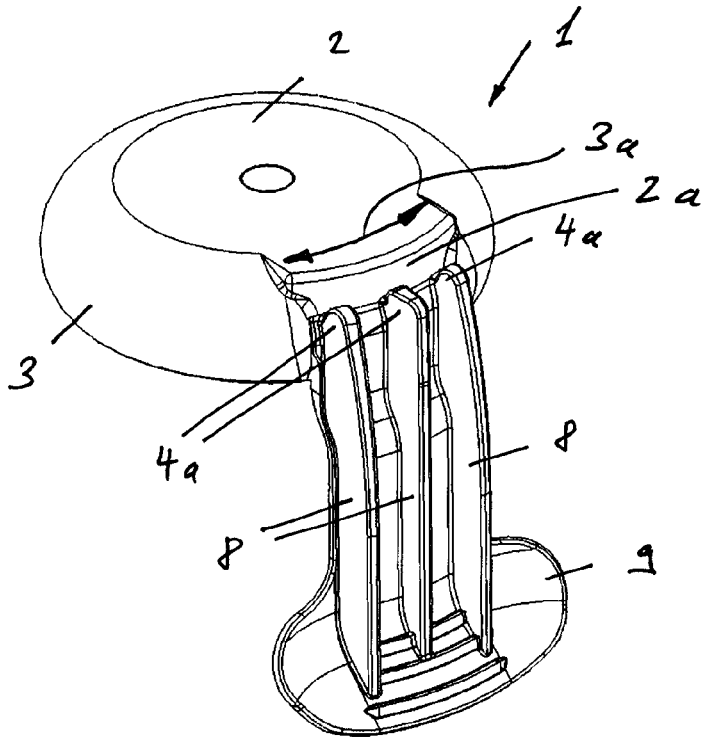
Figure 12:
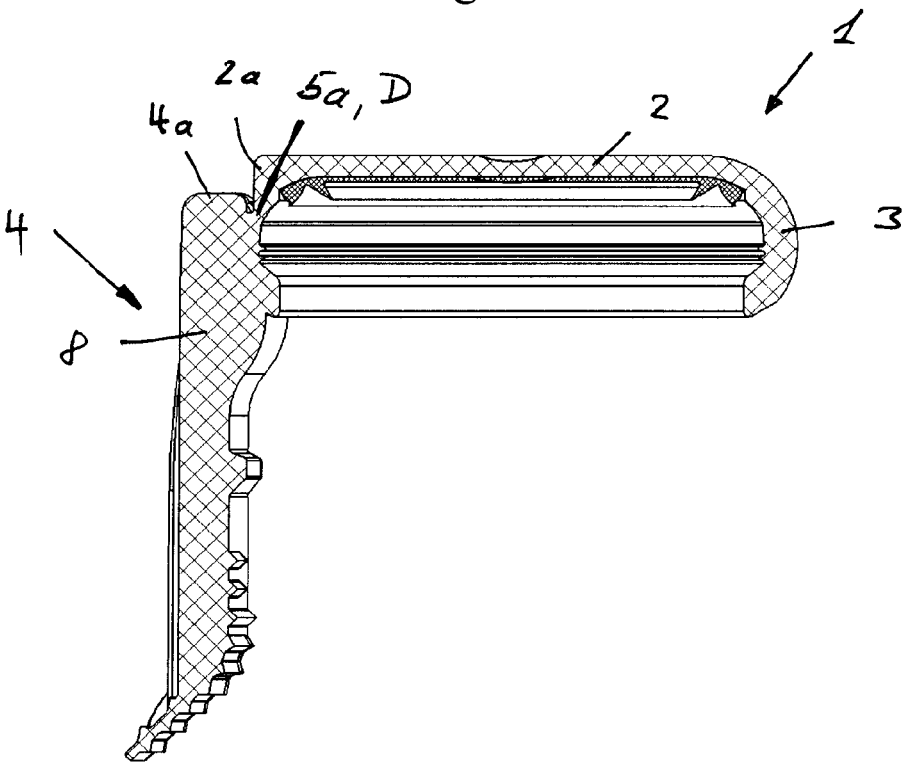

The figures used in explaining the examples of embodiments show:

FIG. 1 a perspective view of a closure cap from above;

FIG. 2 a perspective view of a closure cap from below;

FIG. 3 a side-view of the closure cap;

FIG. 4 a longitudinal section of the closure cap;

FIG. 5 a perspective view of a bottle with closure cap attached;

FIG. 6 a detail view of the longitudinal section of a bottle with closure cap attached;

FIG. 7 a perspective view of a bottle with an opened closure cap;

FIG. 8 a side-view of a bottle with an opened closure cap;

FIG. 9 a longitudinal section of a bottle with an opened closure cap;

FIG. 10 a perspective view of a further example of an embodiment of a closure cap from above;

FIG. 11 a perspective view of a further closure cap from above;

FIG. 12 a longitudinal section of the closure cap depicted in FIG. 11.

Fundamentally in the drawings, identical parts have been given identical reference signs.

DETAILED DESCRIPTION

FIGS. 1 and 2 show perspective views of a closure cap 1 comprising a disc/circular head portion 2 with a central axis M running perpendicularly and concentrically to the head portion 2 and further comprising a cap mantle 3, which, starting from the head portion 2, extends in the same general direction as the central axis M. The closure cap 1 comprises a cap mantle 3, a circular head portion 2 with a central axis M and a pivoting member 4, wherein, starting from the head portion 2, the cap mantle 3 extends in the same general direction as the central axis M, and wherein the cap mantle 3 has a ripping-open-section 3*a* extending circumferentially with respect to the central axis M. The pivoting member 4 is attached to the ripping-open-section 3*a* and extends in the same general direction as the central axis M, wherein, towards the head portion 2, the ripping-open-section 3*a* comprises a thin region 5*a*, which extends circumferentially with respect to the central axis M and which forms a rotational axis D. The pivoting member 4 comprises a stop member 4*a*, which extends in the same general direction as the central axis M at least up to the rotational axis D, wherein the form of the stop member 4*a* and its relative, spaced position with respect to the head portion 2 are such that a pivotation of the pivoting member 4 around the rotational axis D causes the stop member 4*a* to lie against the head portion 2. In the depicted embodiment, the cap mantle 3 has a ripping-open-section 3*a* which is delimited on both sides in the circumferential direction by weak regions (5), which connect the ripping-open-section 3*a* with the rest of the mantle 3. The pivoting member 4 is attached to the ripping-open-section 3*a* and is thereby pivotably attached with respect to the head portion 2. The pivoting member 4 has a protrusion 7 protruding towards the central axis M. This protrusion 7 is spaced apart from the rotational axis D. On its outer side, the pivoting member 4 has three, spaced-apart stiffening ribs 8 and at its lower end it has three ribs 11 running parallel to the rotational axis D and the pivoting member ends in an operating plate 9. As shown in FIG. 2, the operating plate can have a fluted surface 10. In a preferred embodiment, the inner side of the head portion is provided with a so-called 'Liner' 14, as shown in FIG. 2. Such a liner is usually in the form of a small tile which can be laid into the closure cap or inserted into the closure cap or forms a part of the closure cap. In a further embodiment, the liner 14 can have circular sealing lips 15*a*, 15*b*. Such a liner 14 can be made of an oxygen-absorbing/binding material. The inner side of the head portion 2 is preferably provided with such an oxygen-absorbing material.

The pivoting member 4 as well as the stop member 4*a* can be formed in a variety of ways. For example, in contrast to the embodiment shown in FIG. 1, only the two outer ribs 8 could be provided with a stop member 4*a*, or all of the stiffening ribs 8 could be provided with a stop member 4*a*. The stop member 4*a* could also, for example, extend along the whole of the ripping-open-section 3*a* and, for example, all of the stiffening ribs could open up into a single stop member 4*a* extending across the ripping-open-section 3*a*.

FIG. 3 shows the closure cap 1 shown in FIGS. 1 and 2 in a side-view with mantle 3, pivoting member 4, stiffening ribs 8 and protrusion 7. The middle one of the three stiffening ribs 8 is implemented therein as being longer than the two outer stiffening ribs along the general line of direction of the central axis M and comprises the stop member 4*a*. At its lower end, the pivoting member has an operating plate 9. On its inner side, the operating plate 9 has a fluted surface 10 protruding towards the central axis M.

FIG. 4 shows the closure cap shown in FIG. 3 in longitudinal section with mantle 3, pivoting member 4, stiffening ribs 8, protrusion 7, operating plate 9, fluted surface 10 and ribs 11. In a preferred embodiment, the mantle 3 has two protruding lips 12 on its inner surface facing towards the central axis M. The disc-shaped head portion 2 has a recess in its inner surface. The diameter of the recess D2 is preferably larger than the diameter of the head portion D1.

Recess 13 in the inner surface of the head portion 2 creates space to lay a liner 14 into the closure cap. In a preferred embodiment, the liner 14 is inserted into the closure cap using a compression-moulding process. The liner 14 fulfils the requirements for sealing a carbonated drink and provides the necessary gas barriers and oxygen-absorbers for this. In an advantageous liner embodiment 14, there are two circular sealing lips 15*a*, 15*b* at its outer diameter.

In a further, advantageous embodiment, the liner 14 is neither inserted into the head portion 2, nor introduced using a compression-moulding process, but rather the closure cap 1 is made as a single piece also having the functionality of the liner. An additive is mixed in with the basic material to provide the qualities required for the product in terms of sealing, barriers and absorber, such that, in a preferred embodiment, the closure cap 1 may be manufactured as a single piece, injection-moulded part.

FIG. 5 shows a perspective view of a bottle 16 with a bottleneck ring 17 and with a closure cap 1 attached.

FIG. 6 shows a longitudinal section through a bottle 16 with an unopened closure cap 1 attached. The pivoting member 4 lies close to the bottleneck. The protrusion 7 is suitably adapted and arranged such that it comes to rest just underneath the bottleneck ring 17, in particular in order to additionally secure the closure cap 1 to the container 16. In a further possible embodiment, it would also be possible to do without the protrusion 7 on the closure cap 1. With the circular lips 12, the inner surface of the mantle 3 interlocks positively with the mouthpiece 18 of the container 16. The diameter of the liner 14 is made larger than the inner diameter of the outlet orifice of the bottleneck, such that the sealing lips 15*a*, 15*b* of the liner 14 lay onto the end wall surface of the outlet orifice. In a preferred embodiment, as shown in FIG. 6, the inner profile 3*b* of the cap mantle 3 is cambered in the general line of direction of the central axis M in order to embrace the beadlike thickening of the outlet orifice of the bottle 16. In this way, the closure cap 1 can be held securely onto even a pressurised bottle 16.

FIG. 7 shows a perspective view of a closure cap 1 attached to a container 16 with pivoting member 4 pivoted by 90 degrees in direction B 1. The closure cap 1 is opened by the shown movement B1, in which operating plate 9 is lifted away from the surface of the container 16 and then pushed upwards. In doing so, the pivoting member 4 rotates about the rotational axis D established by the thin region 5*a* and, during pivotation of the pivoting member 4, the ripping-open-section 3*a* is lifted and the weak regions 5 which delimit the ripping-open-section 3*a* to the left and to the right tear. It is easily visible that the closure has already been opened from the condition of the torn weak regions 5. In an advantageous embodiment, the pivoting member 4 is attached to the closure cap 1 in such a way that the pivoting member 4 substantially retains its position as achieved following the pivotal movement, so that, alongside the condition of the weak regions 5, it is also clearly and easily apparent that the closure cap 1 has been opened from the pivoting member 4 which, following pivotation stands out from the closure cap 1/container 16. In this embodiment, the weak regions and/or the thin region 5*a* are irreversibly and thereby permanently deformed during deflection by the movement B1.

FIG. 8 shows in side-view the state of the closure cap 1 following the lifting of the pivoting member 4 in the direction of movement B1 by 90 degrees. After the pivoting member 4 has carried out the turning movement B1 about the rotational axis D, the pivoting member 4 takes up a perpendicular position H1 with respect to the central axis M, such that the pivoting member 4 lies in the horizontal plane, in so far as the container is stood upright. In this position, the stop member 4*a* formed by the middle stiffening rib 8 lies above the contact point 19 on the head portion 2. If the pivoting member 4 is now pivoted further in direction of movement B2, then the pivoting member takes on a sort of lever function through the contact point 19 in order to fully remove the closure cap 1 from the container 16 in the same way and manner as a bottle opener.

FIG. 9 shows, in longitudinal section, the bottle 16 with attached closure cap 1 as shown in FIG. 8 with its pivoting member 4 pivoted in the direction of movement B1 by 90 degrees. In a particularly preferred embodiment, the closure cap 1 is formed such that, during pivotation of the pivoting member 4 in direction of movement B1, a channel 20 is effectuated, which forms a fluid-conducting connection between the interior of the container 16 and the exterior of the container 16, such that the pressure may be relieved during opening of the closure cap 1, before the closure cap 1 is fully removed from the bottle 16 by the subsequent movement B2 of the pivoting member 4. This embodiment has the advantage that a slow, continual degassing of the pressure via the channel 20 is thereby possible. The pressure can thereby escape before the closure cap 1 is fully removed from the container 16. The pressure is thereby released while the closure cap is still fixed to the container 16 via the mantle 3. Thus an undesired release of the closure cap 1 while degassing during the opening of the container, due to excessive pressure inside the container 16, is avoided. In an advantageous embodiment degassing may also be influenced via the position of the pivoting member 4, in that the opening and shutting of the channel 20, as well as its cross-sectional area, are influenced by the position of the pivoting member 4.

The channel 20 can be formed in a variety of ways. In particular, the inner profile 3*b* and/or the elasticity of the cap mantle 3 can be formed such that during pivotation of the pivoting member 4, the fluid conducting channel 20 is effectuated first and only after this is the cap mantle deformed in such a way as to allow the closure cap 1 to be fully removed from the container 16.

Geometry, wall thickness and/or material of the closure cap 1 or, in particular, of the liner can also be formed such that upon an excess of pressure in the container 16, a deformation occurs such that a fluid conducting channel 20 is created between the interior of the container and the exterior of the container until the excess pressure has dissipated.

In an advantageous embodiment, the interior profile 3*b* of the cap mantle 3 is formed such that following complete removal, the closure cap 1 can be snapped back onto the outlet orifice of the container 16, such that the closure cap 1 is retained. In a further advantageous embodiment, the outlet orifice is preferably fully sealed. After opening, the closure cap 1 can also advantageously be used as a dust cap in order to keep the contents of the container 16 and preferably also the outlet orifice of the container 16 free of contamination.

FIG. 10 shows a further example of an embodiment of a closure cap 1 according to the present invention, which, in contrast to the embodiment depicted in FIG. 1, has a pivoting member 4 which is much thinner in the circumferential direction with respect to the central axis M. In a preferred embodiment, the ripping-open-section 3*a* has essentially the same width as the pivoting member. Otherwise, the closure cap shown in FIG. 10 is to be opened in the same way as the example of an embodiment shown in FIGS. 1 to 9.

FIG. 11 shows a further example of an embodiment of a closure cap 1, which is different from the closure cap 1 shown in FIG. 1 in so far as the head portion has a stop member 2*a* which advantageously extends across the width of the ripping-open-section 3*a* and in so far as all three stop members 4*a* of the pivoting member 4 are made the same length. FIG. 12 shows a longitudinal section of the closure cap 1 shown in FIG. 11. The only difference in FIG. 12 to the longitudinal section shown in FIG. 4 is to be seen in that the stop members 4*a* are shorter and the head portion 2 comprises the stop member 2*a* arranged on the left hand side. otherwise the closure caps 1 shown in FIGS. 4 and 12 are formed identically. The opening behaviour of the closure cap 1 shown in FIGS. 11 and 12 is very similar to the closure cap 1 shown in FIG. 1, in that a rotational axis D is established by the thin region 5*a* such that the pivoting member 4 is pivotable during opening with respect to the head portion 2, wherein, as from a certain pivotal position, the stop member 4*a* lies against the stop member 2*a* of the head portion such that the pivoting member 4 exerts a lever function on the head portion 2 and the cap mantle 3. It would also be possible in the embodiments shown in FIGS. 11 and 12 for only a single rib 8 or two ribs 8 to have a stop member 4*a* which lies against the stop member 2*a* of the head portion during opening.

In a further example of an embodiment (not shown), the interior profile 3*b* of the cap mantle 3 could be substantially cylindrical with an interior screw thread running along the interior profile as disclosed, by way of example, in the document WO 2005/115865. By such means, this closure cap 1 could, for example, be screwed onto the outlet orifice of the container 16. As shown, for example in FIG. 1, the ripping-open-section 3*a* extends circumferentially with respect to central axis M over a partial section of the cap mantle 3. The weak regions 5 are formed such that there is no interior screw thread under the weak regions 5 or preferably such that the interior screw thread is similarly provided with weak regions 5. On lifting of the pivting member 4, the ripping-open-section 3*a* is lifted and thereby the weak regions 5 are torn, such that the closure cap 1 can be removed from the container 16 by the pivotation of the pivoting member 4 in much the same way as shown in FIGS. 1 to 9.

The weak regions 5 of the closure cap 1 could also be formed and arranged such that they are destroyed upon a violent removal of the closure cap 1, without operation of the pivoting member 4.

The invention claimed is:

1. Closure cap for closing containers, comprising a cap mantle, a circular head portion with a central axis and a pivoting member, in which, starting from the head portion, the cap mantle extends in the same general direction as the central axis, and in which, the cap mantle has a ripping-open-section extending circumferentially with respect to the central axis, and in which, the pivoting member is attached to the ripping-open-section and extends in the same general direction as the central axis, and in which, towards the head portion, the ripping-open-section comprises a thin region, which extends circumferentially with respect to the central axis and which forms a rotational axis between the pivoting member and the head portion, and in which, the pivoting member comprises a stop member, which extends in the same general direction as the central axis and projects past the rotational axis, and in which, the form of the stop member and its relative, spaced position with respect to the head portion are such that pivoting of the pivoting member around the rotational axis causes the stop member to lie against the outer surface of the head portion.

2. Closure cap according to claim 1, wherein the ripping-open-section is delimited in the circumferential direction by weak regions.

3. Closure cap according to claim 1, wherein the pivoting member has a protrusion protruding towards the central axis, wherein, in the general line of direction of the central axis, the protrusion is spaced apart from the rotational axis.

4. Closure cap according to claim 1, wherein the pivoting member has at least one stiffening rib running along the same general line of direction as the central axis on the side of the pivoting member facing away from the central axis.

5. Closure cap according to claim 4, wherein the pivoting member has three stiffening ribs, wherein, along the general line of direction of the central axis, the middle stiffening rib is made longer than the two outside stiffening ribs, and wherein the middle stiffening rib comprises the stop member.

6. Closure cap according to claim 1, wherein, in the general line of direction of the central axis, the interior profile of the cap mantle is cambered.

7. Closure cap according to claim 2, wherein the weak regions are arranged immediately next to the pivoting member, in order that the weak regions are ripped open upon pivoting of the pivoting member.

8. Closure cap according to claim 1, wherein the form and the spatial arrangement of the stop member and of the rotational axis are adapted with respect to the head portion such that the pivoting member works as a lever with respect to the head portion.

9. Closure cap according to claim 8, wherein the form and the spatial arrangement of the stop member and of the rotational axis are adapted with respect to the head portion such that, with respect to the head portion, the pivoting member may be pivoted through an angle of 90 degrees at maximum.

10. Closure cap according to claim 1, comprising an operating plate at an end section of the pivoting member opposite to the stop member.

11. Closure cap according to claim 1, wherein the form and the spatial arrangement of the stop member and of the rotational axis are adapted with respect to the head portion such that, during pivoting of the pivoting member, the head portion may be lifted in the vicinity of the pivoting member in order, during opening, to effectuate a fluid-conducting channel between the container interior and the container exterior.

12. Closure cap according to claim 11, wherein the interior profile and/or the elasticity of the cap mantle is/are formed such that, during pivoting of the pivoting member, the fluid-conducting channel develops first and, only thereafter, the cap mantle deforms such that the closure cap may be removed completely from the container.

13. Closure cap according to claim 1, wherein the ripping-open-section is so-arranged, and the interior profile of the cap mantle is so-formed in relation to a container orifice (16*a*), such that an opened closure cap can reclose the container orifice.

14. Closure cap according to claim 1, wherein, upon an excess of pressure in the container, a deformation occurs, due to the form of the closure cap's geometry, wall thickness, material and/or liner, that creates a fluid-conducting channel between the container interior and the container exterior until the excess pressure has dissipated.

15. Closure cap according to claim 1, wherein the pivoting member or the thin region is formed such that the pivoting member or the thin region essentially retains its position as assumed following the pivotal movement.

16. Closure cap according to claim 2, wherein the weak regions are formed such that they deform plastically during the pivotal movement.

17. Closure cap according to claim 2, wherein the weak regions are formed such that they at least partially tear during the pivotal movement.

18. Closure cap according to claim 11, wherein the interior profile of the cap mantle is formed for reception of a glass beer neck or PET beer neck.

19. Closure cap according to claim 2, wherein the weak regions are formed and arranged such that they are destroyed upon violent removal of the closure cap, without operation of the pivoting member.

* * * * *